United States Patent [19]

Suchanek

[11] Patent Number: 4,669,147

[45] Date of Patent: Jun. 2, 1987

[54] DOOR CLOSER

[76] Inventor: Oldrich Suchanek, Bergendalsvägen 39, S-443 00 Lerum, Sweden

[21] Appl. No.: 694,392

[22] PCT Filed: May 4, 1984

[86] PCT No.: PCT/SE84/00169

§ 371 Date: Jan. 3, 1985

§ 102(e) Date: Jan. 3, 1985

[87] PCT Pub. No.: WO84/04558

PCT Pub. Date: Nov. 22, 1984

[30] Foreign Application Priority Data

May 6, 1983 [SE] Sweden ..... 8302628

[51] Int. Cl.[4] ..... E05F 3/10

[52] U.S. Cl. ..... 16/52; 16/58; 16/DIG. 9; 16/DIG. 10

[58] Field of Search ..... 16/49–53, 16/54, 56–59, 66–68, 70, 80, DIG. 9, DIG. 10; 188/286–287, 288

[56] References Cited

U.S. PATENT DOCUMENTS

| | | | |
|---|---|---|---|
| 942,568 | 12/1909 | Knapp | 16/49 |
| 991,674 | 5/1911 | Voight | 16/49 |
| 1,223,408 | 4/1917 | Loftsgaarden | 16/49 |
| 2,122,162 | 6/1938 | Smith | 16/49 |
| 3,161,908 | 12/1964 | Walach | 16/52 |
| 4,073,033 | 2/1978 | Lexnas | 16/52 |
| 4,372,005 | 2/1983 | Inesso | 16/58 X |

FOREIGN PATENT DOCUMENTS

| | | |
|---|---|---|
| 2,633,787 | 2/1978 | Fed. Rep. of Germany . |
| 29,564 | of 1910 | United Kingdom . |

*Primary Examiner*—Donald R. Schran

*Assistant Examiner*—James L. Wolfe

*Attorney, Agent, or Firm*—Bacon & Thomas

[57] ABSTRACT

A door closer has a first arm (4, 14) which is pivotally attached to the door case (2), a second arm (5, 15) which is pivotally attached to the door leaf (1), the opposite ends of the two arms being pivotally connected to each other (at C), and a spring biased driving device (6, 16) which is pivotally attached partly to the door case (at E), partly to the linkage system formed by the arm (4, 5; 14, 15). According to the invention the driving device (6, 16) is pivotally attached to the second arm (5, 15) at a distance from its joint (6) on the first arm (4, 14), and its joint (E) on the door case is located between the joints (A and B respectively) of the first and second arms (4, 5; 14, 15) on the door case and the door leaf respectively, the joint (B) of the second arm (5, 15) being located closest to the hinge joint (D) of the door. In a preferred embodiment the following relation applies for the door closer:

$$a+b>2c+d$$

wherein a and b is the length of the first and the second arms respectively (4, 5; 14, 15), c is the distance between the hinge joint (D) of the door and the joint (B) of the second arm (5, 15) on the left leaf (1), and d is the distance between the joint (A) of the first arm (4, 14) on the door case and the joint (B) of the second arm (5, 15) of the door leaf (1) when the door is closed, whereby the door closer provides the greatest closing force when the door is closed while at the same time its resistance to door opening decreases with increasing door opening angle.

9 Claims, 7 Drawing Figures

DOOR CLOSER

Figure 1:
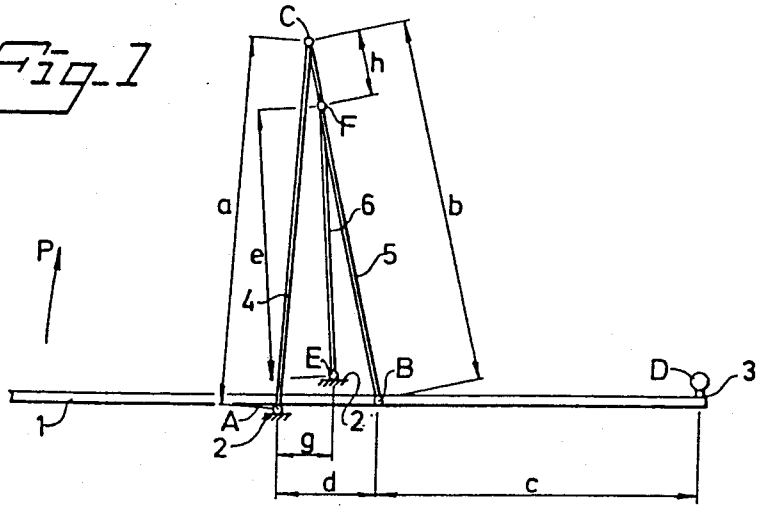

The present invention relates to a door closer, i.e. a device which is connected between the door leaf and the door case for automatically closing an opened door. The door closer according to the invention makes it possible to open/close the door up to 180°. It can give the greatest closing force when the door is in the very closing position, as well as a closing force which decreases with increasing opening angle for the door. The door closer according to the invention is especially, but not exclusively, intended for light and medium weight inner and outer doors. It is especially well suited for narrow door case profiles and in narrow places, e.g. on doors adjacent to angular walls.

The problem of automatically closing opened doors in a controlled manner has been observed since a very long time, and many different suggestions for solving the problem have been presented. For example, already in 1898 (U.S. Pat. No. 598,442) a door closer was disclosed comprising a piston/cylinder assembly which was interconnected between a link arm system pivoted on the door and the door case respectively. The purpose was to prevent too abrupt closing of the door, e.g. because of heavy wind draft. To this end an angled arm arrangement was used at the joint on the door leaf, which cooperated with a buffer of e.g. rubber on the door case to dampen the closing force in the last closing moment. Because of the design with the joint on the door leaf located most remote from the hinge, the door could not be opened completely.

Another example of a door closer, which has been known for a long time, is found in GB-A-127,225 (1919), which shows a piston/cylinder assembly provided with springs, which are compressed when the door is opened and provide the closing force when the door is being closed. An air throttle valve dampens the closing motion, and at the end thereof an air discharge valve is opened by contacting an external stop, the spring power taking care of the very closing of the door. The device permits only limited control of the dampening of the door closing, and the door can be opened 90° at most.

As a further example of known door closers DE-B-2,633,787 can be mentioned, which shows another variation of a door closer having the joint on the door leaf located most remote from the hinge joint, in this case with this joint designed as a double joint having an extra link arm. Also in this case there is no possibility of full door opening, and the possibilities of controlled damping of the closing force are limited.

GB-A-29564 (1909) discloses another variation of a door closer, wherein a double driving assembly (comprising a spring and a pneumatic piston/cylinder unit) is connected between the door frame and a short link arm, or lever, which is also mounted on the door frame. A long lever is connected between the door leaf and the free end of the short lever. Also this door closer has considerable limitations, e.g. as to the kinetics of the closing of the door.

The invention aims at eliminating or minimizing these and other problems of known door closers. It in particular aims at providing a simple, compact and efficient door closer, which is easy to set up and provides an optimal closing force in the very closing moment and for the rest can give a closing force which is smaller the more the door is opened. The invention also aims at providing a door closer of the indicated type, which makes it possible to open the door up to 180°, if desired with disconnection of the closing force at large opening angles. The invention further aims at providing a hydraulic door closer whose damping effect—and consequently closing speed—can be controlled at intervals as desired depending on the opening angle, e.g. rapid closing down to about 100° opening angle, medium speed closing between about 100° and about 40°, and slow speed closing therebelow, an optimal closing force being developed at the very closing, i.e. when the door is moved into the door case and the lock snaps into the corresponding securing plate.

Figure 4:
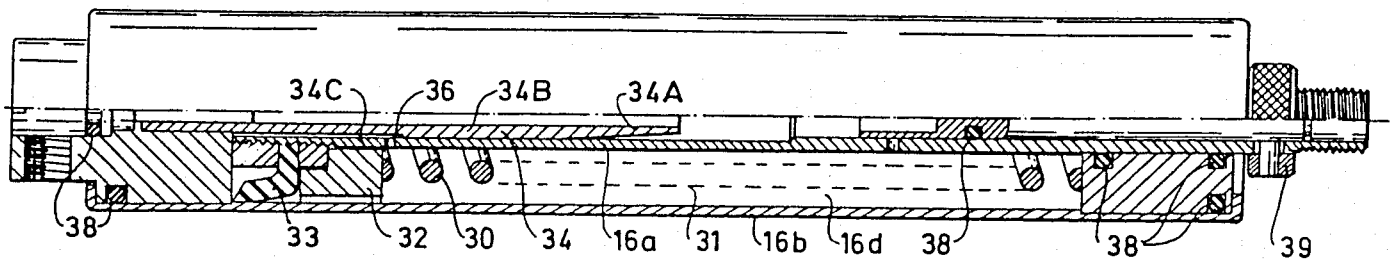
Figure 2:
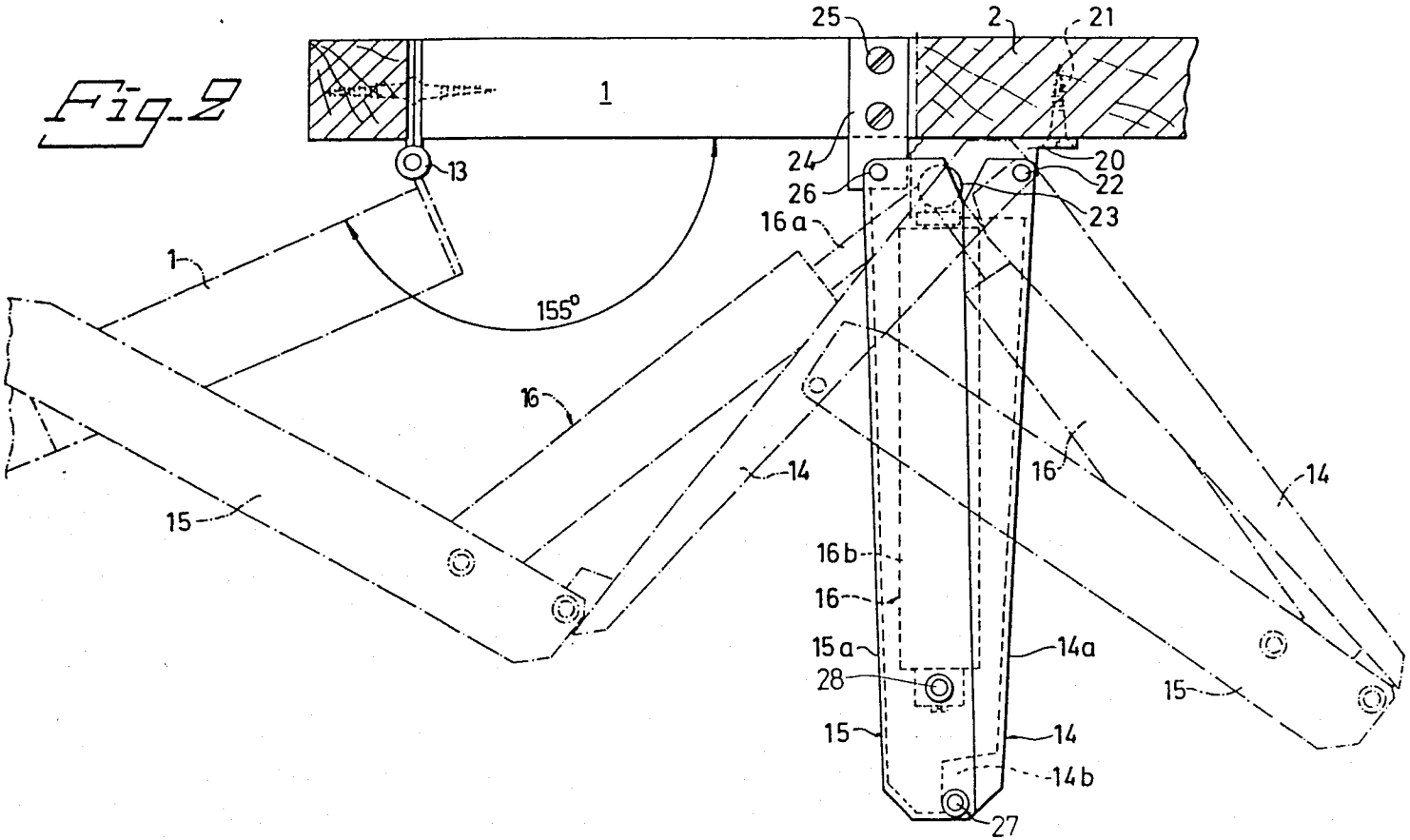

These and other objects of the invention are achieved in that the door closer has been given the characteristic features which are indicated in the subsequent claims and which will be explained further below with reference to the enclosed drawings, in which:

FIG. 1 is a schematic top plan view of a mounted door closer according to the invention, FIG. 2 is a part view from above of a preferred embodiment of the door closer according to the invention, shown in three different positions for the door, FIGS. 3A–D are schematic part views in longitudinal section showing the flow of hydraulic oil for different door opening angles in a preferred embodiment of a hydraulic piston/cylinder assembly used in the door closer according to the invention; and FIG. 4 is a longitudinal section of the hydraulic piston/cylinder assembly in the preferred embodiment of the door closer according to the invention.

In the outline diagram of FIG. 1 reference numeral 1 designates a door which is suspended in a door case 2 by means of hinges 3. The door closer according to the invention comprises a linkage system interconnecting the door leaf 1 with the door case 2. The linkage system comprises a first link arm 4 which is pivotally attached to the door case 2 at the joint A, and a second link arm 5 which is pivotally attached to the door leaf 1 at the joint B, located between the joint A and the hinge joint D. The two link arms 4, 5 are pivotally connected to each other at their opposed ends, at the joint C.

A piston/cylinder assembly 6, which is spring biased towards its retracted position, is pivotally interconnected between the door case 2 (the joint E) and the second link arm 5 (the joint F). The joint E on the door case is located between the joint A of the first link arm 4 on the door case 2 and the joint B of the second other link arm 5 on the door leaf 1.

On opening of the door (arrow P) the piston of the piston/cylinder assembly 6 is withdrawn from its cylinder while compressing the biasing spring located therein (cf. FIGS. 2, 3 and 4). The closing of the door (in a direction opposite to the arrow P) is effected automatically by the power accumulated in the spring, which power can be dampened in a controlled manner, as will be described below.

In order to obtain, in accordance with the invention, the desired distribution of power and opening amplitude, i.e. with the greatest closing force at the opening angle 0° and a closing force which decreases with increasing angle of door opening, as well as a possibility of 180° door opening, it is essential that the following relation applies when the door is in the closed position:

$$a+b \geqq 2c+d$$

wherein a and b is the length of the first arm 4 and the second arm 5 respectively, c is the distance between the hinge joint D and the joint B of the second arm 5 on the door leaf 1, and d is the distance between the joint A of the first arm 4 on the door case and the joint B of the second arm 5 on the door leaf.

In FIG. 1 the distance g indicates the distance between the joints A and E for the first arm 5 and the piston/cylinder assembly 6 respectively on the door case 2, and h represents the distance between the common joint C of the two arms 4, 5 and the joint F of the piston/cylinder assembly 6 on the second arm 5. When the other conditions remain unchanged (i.e. constant measures for the distances a, b, c, d and h) then the following applies:

(a) when the joint E is moved closer to the joint B (i.e. the distance g increases), then the closing force at small door opening angles increases while at the same time the closing force decreases at large opening angles, and (b) when the joint E is moved closer to the joint A (i.e. the distance g is reduced), then the final closing force is reduced whereas the closing force at large angles is increased.

It appears from the above that the closing force profile of the door closer can be adjusted in simple manner, e.g. by arranging the joint E such that it can be moved relative to the joint A and secured in different positions, e.g. continuously.

In the preferred embodiment, which is shown in FIG. 2, the link arms 4 and 5 substantially consist of two U-profiles 14, 15 which, when the door 1 is closed, are arranged to enclose the piston/cylinder assembly 16. See the position shown in full lines in FIG. 2, wherein the edges of the legs of the U-profiles 14, 15 contact each other, their bottoms 14*a*, 15*a* completing the enclosure of the piston/cylinder assembly 16, which is thus protected by the U-profiles when the door is in the closed position.

A fork holder 20 is secured to the door case 2, e.g. by means of screws 21, and pivotally carries the first U-profile 14 and the piston/cylinder assembly 16. The U-profile 14 is mounted in the fork holder 20 by means of a pin 22 extending through both of the legs of the U-profile 14. The pin 22 corresponds to the joint A in FIG. 1. The piston rod 16*a* of the piston/cylinder assembly 16 is pivotally attached to the holder 20 by means of shaft journal 23 corresponding to the joint E in FIG. 1. The shaft journal 23 is preferably carried by a suitable insert which can be secured in desired positions in the holder 20, so that the distance from the shaft journal 23 to the pin 22—and consequently the closing force profile—can be varied by simple adjustment of the position of the insert (see the above discussion of the effect of changing the distance g in FIG. 1).

A mounting plate 24 is attached to the top edge of the door leaf 1, e.g. by means of screws 25. The plate 24 is countersunk in the top edge of the door in order not to obstruct closing of the door. The second U-profile 15 is pivotally mounted on a projecting tongue of the screw plate 24 by means of a pin 26 passing through both legs of the U-profile. The pin 26 corresponds to the joint B in FIG. 1. The opposite end of the second U-profile 15 is pivotally mounted on the end of the first U-profile 14 (via a mounting piece 14*b* provided on the same) by means of a pin 27, which corresponds to the joint C in FIG. 1.

The cylinder part 16*b* of the piston/cylinder assembly 16 is pivotally mounted on the second U-profile 15, between its two legs, by means of a pin 28. This pin corresponds to the joint F in FIG. 1. The hinge joint D in FIG. 1 corresponds to a hinge pin 13.

In the shown preferred embodiment the piston/cylinder assembly 16 is hydraulic, and it is in a manner known per se provided with a piston with a corresponding piston rod 16*a* running in the surrounding cylinder 16*b*. A spring keeps the piston/piston rod pressed into the cylinder towards the closed door position, as shown in full lines in FIG. 2. The piston is provided with a check valve permitting hydraulic oil to be passed behind the piston when the door is opened and the piston rod is withdrawn from the cylinder while compressing the biasing spring. These and other details of the preferred piston/cylinder assembly will be explained further in connection with FIGS. 3 and 4.

The movement of the two U-profiles 14, 15, the piston/cylinder assembly 16, and the door 1 appears from FIG. 2. When the door is opened from the closed position, indicated in full lines, it passes the dash-dotted position to the right—corresponding to a door opening of about 27°—and is on further opening moved to and, when necessary, beyond the dash-dotted position to the left, about 155° door opening. The profile of the opening force is substantially as has been explained in connection with FIG. 1. On opening beyond about 155° the force can optionally be disconnected so that the door is not affected by the piston/cylinder assembly and thus can remain in the open position.

The automatic closing of the door takes place by the action of the bias of the pressure spring 30, which tends to again push the piston rod 16 into the cylinder 16*b*. In order to make this possible the hydraulic liquid 31 has to be recirculated to the opposite side of the piston 32. However, this cannot be done through the check valve 33 since the same only lets the hydraulic liquid through in the opposite direction (i.e. on opening of the door). In accordance with the invention the recirculation of the hydraulic liquid 31 preferably takes place via a plurality of flow paths having varying flow capacity (throttle valve or damping function). By changing the degree of damping depending on the opening angle of the door the closing speed of the door can be controlled, e.g. in accordance with the illustration in FIGS. 3A–D, which schematically show the recirculation path of the hydraulic liquid for different door opening angles. The piston 32 comprises a check valve 33 designed as a cylindrical elastic sleeve, which because of its shape permits the hydraulic liquid to flow past the piston 32 around the same when the piston 16*a* is withdrawn from the cylinder 16*b*, but which seals against the cylinder and prevents the hydraulic liquid from being pressed beyond the check valve sleeve 33 in the opposite direction. The piston 32 is attached to the piston rod 16*a*, which is tubular and centrally mounted on a pin 34 having a bevelled or conical front portion 34A, a straight intermediate portion 34B and a retracted end portion 34C. At the mounting end of the pin 34 there is a control valve 35, which interconnects the cylinder space 16*c* behind the piston 32 with the interior of the center pin 34. In the wall of the tubular piston rod 15*a* there is provided a vent hole 36 and a control valve 37. The spring 30 urges the piston rod 16*a* towards the retracted position (closed door—FIG. 3D). For an ordinary door of about 20 kg the spring bias can, for example, be of the order of 150N.

Figure 3A:
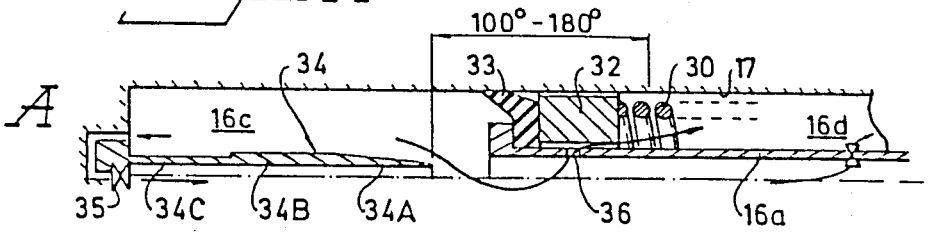
Figure 3B:
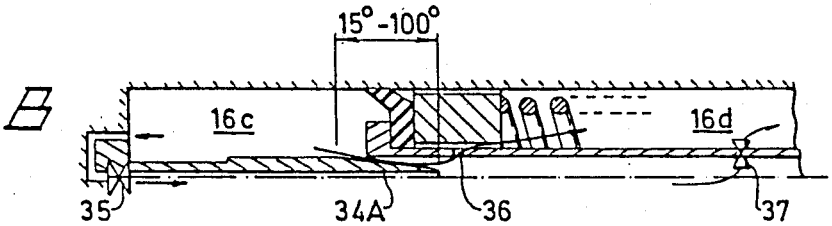
Figure 3C:
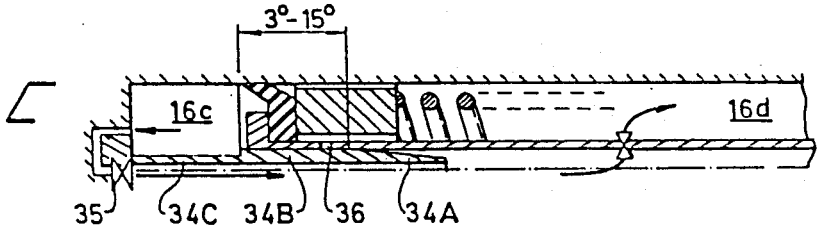
Figure 3D:
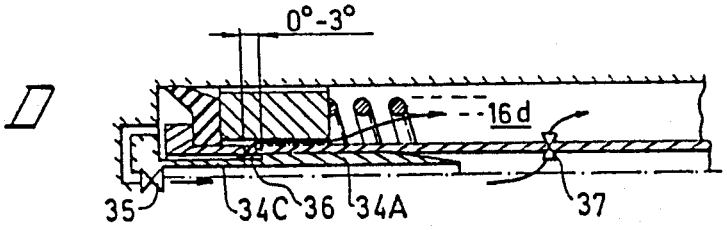

FIG. 3A illustrates the back flow of hydraulic liquid at large door opening angles, for example from 180° to about 100°. In this angular interval the oil has a free path from the cylinder chamber 16c on one side of the piston 32 to the cylinder chamber 16d on the opposite side of the piston. This is because the piston is located in front of the center pin 34 and because the vent hole 36 is unobstructed. Thus, the closing of the door takes place substantially without any special damping by the flow of hydraulic liquid.

When the end of the piston rod reaches the front edge of the center pin the oil flow between the pin and the piston rod is throttled progressively the more the piston rod 16a is moved into the cylinder 16b, because of the conicity of the end of the center pin. See FIG. 3B. The oil can also pass through the control valve 35, which thus also can influence the damping. This progressive throttling can e.g. take place in the angular interval about 100°–about 15°. The degree of damping and the damping interval can be varied by changing the length of the conic portion 34A and its angle of inclination.

When the piston rod 16a has passed the conical portion 34A of the center pin 34 its vent hole 36 will be obstructed by contacting the straight intermediate portion 34B of the pin 34, so that all oil is forced to flow through the control valves 35 and 37. See FIG. 3C. Preferably, the valve 37 provides for the major dampening function, whereas the valve 35 primarily serves to adjust irregularities in the closing process. This stronger damping function, which provides for slow closing of the door, can e.g. be used over the angular interval about 15°–about 3°.

When the piston rod 16a has been pushed further into the cylinder 16b the hole 36 is unobstructed because it has left the pin portion 34B and is located opposite the retracted pin portion 34C. See FIG. 3D. The hydraulic oil can then freely pass through the hole 36 (and, of course, also through the control valve 37), so that the damping ceases and the full closing force is obtained at the very closing of the door, e.g. in the angular interval about 3°–0°.

FIG. 4 shows the presently preferred design of the piston/cylinder assembly in more detail. Corresponding details are designated with the same reference numbers as in FIGS. 1–3. The assembly is shown in the closing position corresponding to FIG. 3D. 38 designates O-ring seals. 39 designates an adjustment ring, by means of which the spring biasing and the axial position of the piston rod 16a in the cylinder 16b—and consequently relative to the cenral pin 34—can be adjusted.

For e.g. lock-free doors, where there is no need for an extra force at the very closing moment, the biasing force can be increased and the starting position of the piston rod 16a be somewhat more retracted, e.g. so that the vent hole 36 in the end position does not reach the pin portion 34C, whereby no disconnection of the damping takes place. On the other hand a large total closing force is achieved. By such adjustment the spring biasing can be readjusted from e.g. about 140N (for a door having a lock) to about 170N (lock free door).

The invention is, of course, not limited to the embodiment which has been specifically described above and shown in the drawings, but many modifications and variations are possible within the the scope of subsequent claims. Although it is preferred to use a power damping system which is hydraulic, it is within the scope of the invention also possible to make use of other types of biased power assemblies which can provide the necessary driving force for the linkage system according to the invention. The basic idea of the invention can be applied also without using angularly differentiated damping of e.g. the hydraulic cylinder on closing of the door, although this is desirable and preferred. It would also be obvious to a person skilled in the art that damping of the spring biasing force can be achieved by many other means that the flow paths and control valves for the recirculation of the hydraulic liquid which have been specifically described herein. It would also be obvious that the described check valve sleeve can be replaced by other types of check valves, e.g. a ball valve.

I claim:

1. A door closer for a door assembly having a door case, a door leaf and a hinge joint, which closer comprises:

(a) a first arm including one end for pivotal attachment to the door case at a first pivot joint;

(b) a second arm including one end for pivotal attachment to the door leaf at a second pivot joint;

(c) the opposite ends of the first and second arms being pivotally connected to each other at a third pivot joint to define a linkage system;

(d) a spring-biased driving device including one end for pivotal attachment to the door case at a fourth pivot joint and the other end being pivotally connected to the second arm at a fifth pivot joint spaced from the third pivot joint;

(e) the fourth pivot joint being disposed between the first and second pivot joints, with the second pivot joint being positioned closest to the hinge joint when the closer is attached to the door assembly in its position of use; and (f) the following relationship applies:

$$a+b>2c+d,$$

wherein a and b are the respective lengths of the first and second arms, c is the distance between the hinge joint of the door and the second pivot joint when the closer is attached to the door assembly in a position of use, and d is the distance between the first and second pivot joints when the door is disposed in a closed position, whereby the closer provides the greatest closing force when the door is in the closed position while simultaneously providing resistance to opening of the door which decreases with increase in a door opening angle defined by the angle between the door being in its fully closed position and a given open position.

2. The door closer of claim 1 wherein the spring-biased driving device is defined by a hydraulic cylinder, a piston insertable within the cylinder, a piston rod, a spring biasing the piston towards a fully inserted position within the cylinder, a check valve permitting hydraulic fluid to pass beyond the piston when the piston rod is withdrawn from the cylinder but not in the opposite direction, and at least one flow path for the hydraulic fluid which, under damping action, permits hydraulic fluid to flow back in front of the piston when the piston is inserted into the cylinder.

3. The door closer of claim 2 further including at least two flow paths for hydraulic fluid, the flow paths having different degrees of damping, which are connected and disconnected depending on the degree of insertion of the piston rod into the cylinder, and which depends on the door opening angle.

4. The door closer of claim 2 further including a first flow path for the hydraulic fluid which permits substantially undamped backflow of hydraulic fluid within a first range of door opening angles and a second flow path which permits a moderate damping of the backflow of hydraulic fluid within a second range of door opening angles.

5. The door closer of claim 4 further including a third flow path which permits relatively large damping of the backflow of hydraulic fluid within a third range of door opening angles.

6. The door closer of claim 5 wherein the first range of door opening angles is between about 100°–180°, the second range of door opening angles is between about 15°–100°, and the third range of door opening angles is between the door being in its fully closed position and about 15°.

7. The door closer of claim 2 further including a flow path for hydraulic fluid which permits substantially undamped backflow of hydraulic fluid when the door approaches a closing position at a door opening angle of about 3°, whereby a maximum closing force is imparted to the door at the moment of door closing.

8. The door closer of claim 1 wherein the position of the fourth pivot joint is adjustable in order to permit adjustment of the distance between the fourth pivot joint and the first pivot joint.

9. The door closer of claim 8 wherein the position of the fourth pivot joint is continuously adjustable.

* * * * *